US011266205B2

(12) United States Patent
Benchoff et al.

(10) Patent No.: US 11,266,205 B2
(45) Date of Patent: Mar. 8, 2022

(54) WEARABLE SHOE SHAPER

(71) Applicant: Shoe-Vital LLC, Buffalo, WY (US)

(72) Inventors: Warren Benchoff, Cedar Creek, TX (US); Aaron Garza, San Diego, CA (US)

( * ) Notice: Subject to any disclaimer, the term of this patent is extended or adjusted under 35 U.S.C. 154(b) by 146 days.

(21) Appl. No.: 16/709,187

(22) Filed: Dec. 10, 2019

(65) Prior Publication Data

US 2020/0170350 A1 Jun. 4, 2020

Related U.S. Application Data

(63) Continuation-in-part of application No. 29/713,544, filed on Nov. 15, 2019, now Pat. No. Des. 880,142, which is a continuation of application No. 29/640,640, filed on Mar. 15, 2018, now Pat. No. Des. 871,051, application No. 16/709,187, which is a continuation-in-part of application No. 29/713,545, filed on Nov. 15, 2019, now Pat. No. Des. 880,143, which is a continuation of application No. 29/640,640, filed on Mar. 15, 2018, now Pat. No. Des. 871,051, application No. 16/709,187, which is a continuation-in-part of application No. 29/640,640, filed on Mar. 15, 2018, now Pat. No. Des. 871,051.

(51) Int. Cl.
*A43B 23/08* (2006.01)

(52) U.S. Cl.
CPC ..... *A43B 23/087* (2013.01)

(58) Field of Classification Search
CPC ..... A43B 7/147; A43B 23/08; A43B 23/087; A43B 23/081; A43D 3/00; A43D 3/1433
See application file for complete search history.

(56) References Cited

U.S. PATENT DOCUMENTS 564,966 A * 8/1896 Brewer ..... A43B 23/086 36/77 R
1,965,431 A * 7/1934 Prewitt ..... A43B 23/081 36/77 R
2,180,996 A * 11/1939 Prewitt ..... A43B 23/07 36/55
2,381,280 A * 8/1945 Handelsman ..... A43B 23/082 36/77 R
2,443,725 A * 6/1948 Cobb ..... A43B 23/081 36/77 R
2,747,303 A * 5/1956 Abrahams ..... A43C 13/14 36/72 R
3,561,142 A 2/1971 Streit, Sr. et al.
3,950,865 A * 4/1976 Gray ..... A43B 23/082 36/77 R
D282,022 S * 1/1986 Wright ..... 36/8.3
4,656,761 A * 4/1987 Lord ..... A43C 13/14 36/72 R
4,735,003 A * 4/1988 Dykeman ..... A43B 23/087 36/77 R
D316,772 S 5/1991 Rose
(Continued)

*Primary Examiner* — Jillian K Pierorazio

(74) *Attorney, Agent, or Firm* — Enrique A. Monteagudo, Esq.

(57) ABSTRACT

The present disclosure relates to a shoe shaper or pair of shoe shapers that may be worn by a user while wearing a pair of shoes. In particular, each wearable shoe shaper is a complex contoured sheet configured to fit over a user's foot in a front portion of the shoe. Each wearable shoe shaper includes one or more features related to performance and or comfort.

18 Claims, 10 Drawing Sheets

(56) References Cited

U.S. PATENT DOCUMENTS

| | | | | | |
|---|---|---|---|---|---|
| 5,074,060 | A * | 12/1991 | Brncick | A43C 13/14 | 36/77 R |
| 5,457,898 | A * | 10/1995 | Fortin | A43C 13/14 | 36/72 R |
| 5,832,633 | A * | 11/1998 | Wang | A43B 23/086 | 36/77 R |
| 5,878,511 | A * | 3/1999 | Krajcir | A43B 23/082 | 36/77 R |
| D420,784 | S * | 2/2000 | Riecken | D2/909 | |
| 6,170,174 | B1 | 1/2001 | Gesso | | |
| 6,367,170 | B1 * | 4/2002 | Williams | A43B 23/086 | 36/77 M |
| 6,412,195 | B1 * | 7/2002 | Mack | A43B 23/082 | 36/114 |
| 6,598,323 | B1 | 7/2003 | Gougelet et al. | | |
| D485,020 | S * | 1/2004 | Yake | D29/121.2 | |
| D787,788 | S * | 5/2017 | Nelson | D2/913 | |
| 2005/0022421 | A1 * | 2/2005 | Bruckner | A43B 23/081 | 36/8.3 |
| 2006/0070262 | A1 | 4/2006 | Shaw et al. | | |
| 2007/0089249 | A1 | 4/2007 | Bordin et al. | | |
| 2008/0148607 | A1 * | 6/2008 | Spar | A43B 23/081 | 36/77 M |
| 2010/0325817 | A1 * | 12/2010 | Siragusa | A43B 23/081 | 12/128 B |
| 2013/0255111 | A1 * | 10/2013 | Sakurai | A43B 23/082 | 36/77 R |
| 2014/0115795 | A1 * | 5/2014 | Almaguer | A43D 1/08 | 12/146 R |
| 2016/0213096 | A1 * | 7/2016 | Borel | A43B 7/085 | |
| 2018/0125149 | A1 * | 5/2018 | McHugh | A43B 23/087 | |

* cited by examiner

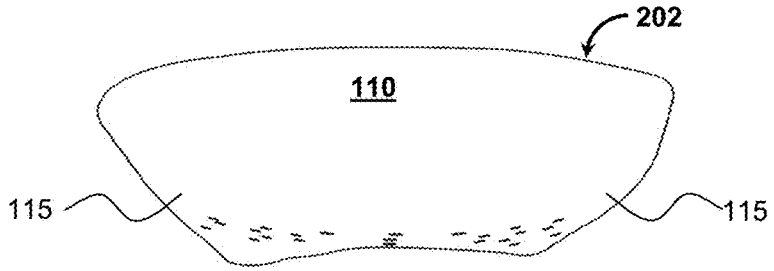
FIG 5B
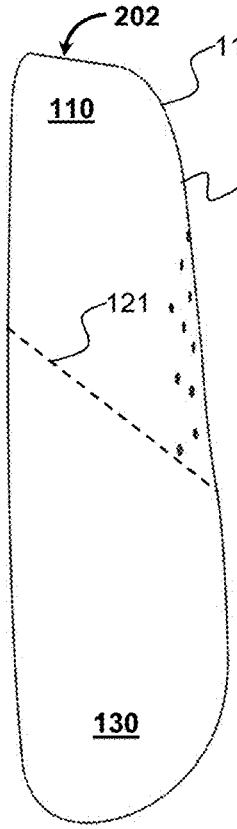
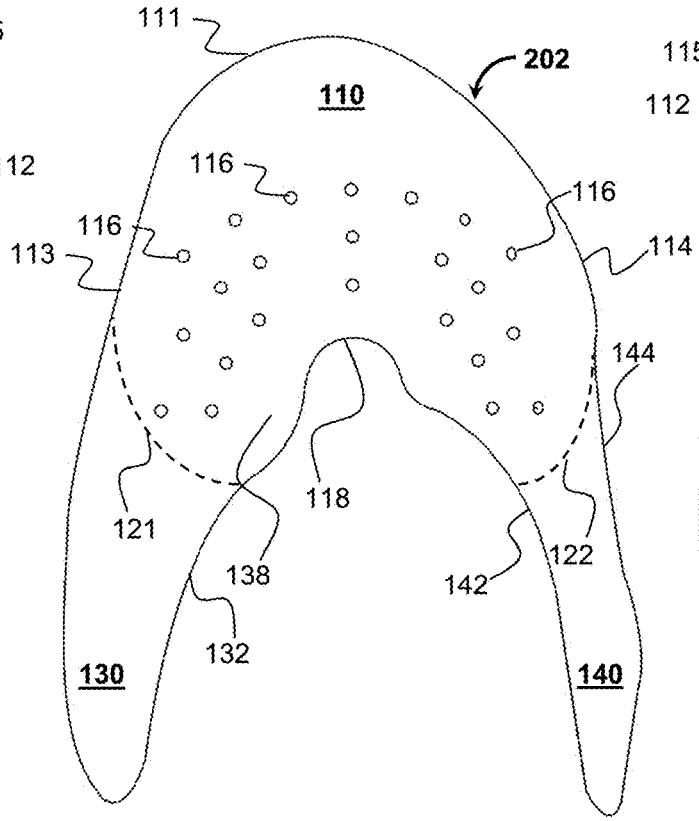
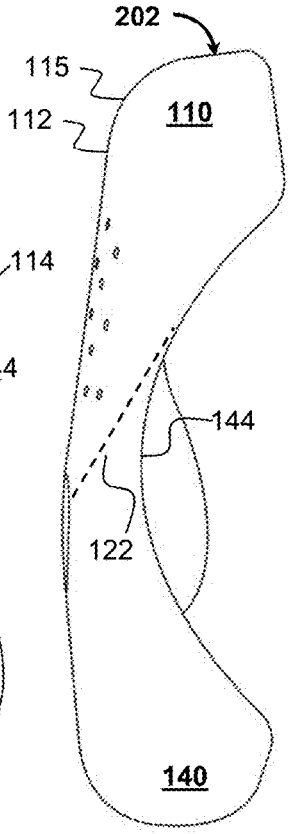
FIG 5C FIG 5A FIG 5D

WEARABLE SHOE SHAPER

CROSS-REFERENCE TO RELATED APPLICATIONS

This application claims priority to both U.S. patent application Ser. No. 29/713,544, filed Nov. 15, 2019 and entitled LEFT SHOE SHAPER, and to U.S. patent application Ser. No. 29/713,545, filed Nov. 15, 2019 and entitled RIGHT SHOE SHAPER, each of which claiming priority to U.S. patent application Ser. No. 29/640,640, filed Mar. 15, 2018 and entitled PAIR OF SHOE SHAPERS, the contents of all of which are incorporated herein by reference in its entirety.

BACKGROUND OF THE INVENTION

Technical Field

The present disclosure generally pertains to shaped articles which are inserted in shoes to hold their shape, and is more particularly directed toward said shaped articles formed as a contoured article that can remain in the shoe when the shoe is worn.

Related Art

Many traditional shoes and sneakers are made of an upper and a lower or sole bound together. The lower/sole (hereinafter the lower) is the portion that is in contact with the ground, and the upper is the part of the shoe that encases the foot on top of the lower. The upper typically includes the following (or similar) components that are well-known in the art: a toe cap (or toe box), a heel, a vamp, a quarter, and lacing. The toe cap is generally a protective area at the front of the shoe that encloses the toes. The heel is generally the part at the back or aft of the shoe which may be stiffened and may have a seam up the center of it at the aft of the shoe. The quarter generally extends forward from the heel to opposing sides of the laces. Similarly, the vamp commonly extends aft from the toe box to opposing sides of the quarter.

In some shoes, after the first few steps, a crease appears on the forward toe area of the shoe usually just forward of the laces (e.g., vamp and/or toe cap). For many wearers, this may be highly undesirable, unstylish, and may give the shoes an appearance of being old and worn. Traditionally, dress shoes, by definition are valued for their appearance and frequently lack comfort. More recently, sneakers/athletic shoes have evolved into a similar situation where they too are valued for their appearance, in addition to their performance and comfort.

Currently, to address shoe creasing created while walking, there are foam inserts that are inserted into the shoe and using double-sided tape, are held to it above the toe region. Foam inserts, however, are inadequate to address this problem for many reasons. For example, and just to name a few, existing foam inserts do not provide any structural support to the sides of the shoe, they do not provide any ventilation to the top of the shoe, and they generally do not stay in place.

Likewise, to address to address shoe creasing created while walking, there are also wearable shoe trees. Wearable shoe trees are similar to Existing wearable shoe trees are inadequate for many reasons. For example, the wearable shoe tree does is very limited in its shape, not fit or align with most shoes for complete protection, and may have poor performance. Also, for example, and as above, existing wearable shoe trees do not provide adequate support to the front, top, and sidewall of the shoe, they do not have reinforced areas prone to failure (e.g., along the pinky toe area), and they do not have a "right" or "left" shape, which can particularly problematic when worn with rigid dress shows that already lack comfort. Further, the wearable shoe tree may be uncomfortable for the wearer. This particularly the case with sneakers/athletic shoes as they fail to fill the entire toe cap tip area of most sneakers, they do not allow adequate room for the outer toes, and are contoured to the shoe instead of to the top of the foot, which can particularly problematic when worn during athletic or otherwise active times.

U.S. Pat. App. Pub. No. 2010/0325817 by Siragusa, published on Dec. 30, 2010, shows the abovementioned wearable shoe tree. In particular, the disclosure of Siragusa is directed toward a wearable shoe tree to be inserted within the interior of various types of shoes, thereby helping maintain the original shape of the shoe and preventing the front area (or toe box area), side walls, and heal from creasing and wrinkling over time. The wearable shoe tree can be comfortably worn and keeps the shape of a shoe whether the shoe is being worn or not. In addition to maintaining the shape and aesthetics of the shoe, the can also be used as an aid to athletic shoe customization. Modifications can be made to the shoe tree to allow it to be permanently affixed into the shoe or to allow it to be used by handicapped individuals for aesthetic purposes.

The present disclosure is directed toward overcoming known problems and/or problems discovered by the inventors.

SUMMARY OF THE INVENTION

The present disclosure relates to a shoe shaper or pair of shoe shapers that may be worn by a user while wearing a pair of shoes for both style and comfort. In particular, each wearable shoe shaper is a complex contoured sheet configured to fit over a user's foot in a front portion of the shoe. Each wearable shoe shaper includes one or more features related to performance and or comfort.

A wearable shoe shaper for a shoe worn by a user is disclosed herein, with the shoe having an upper, and a lower and defining a front, a back, an inner side, an outer side, a top, a bottom, an inside and an outside. The wearable shoe shaper includes a toe box, an inner wing, and an outer wing. The toe box is formed from a contoured sheet configured to fit inside the shoe between a foot of the user and the shoe upper when worn. The toe box has a top side, an inner side, and an outer side, relative to the shoe. The toe box is configured to cover at least four toes of a human foot. The toe box is further configured to conform to asymmetrical shapes and dimensions of one of a left human foot or a right human foot. The inner wing is formed from the contoured sheet, extending backward from the top and the inner side of the toe box, the inner wing including an inner foot interface configured to rest against an inner side of the human foot proximate a first metatarsal bone of said human foot. The outer wing is formed from the contoured sheet, extending backward from the top and the outer side of the toe box, the outer wing including an outer foot interface configured to rest against an outer side of the human foot proximate a fifth metatarsal bone of said human foot.

According to one embodiment, a pair of wearable shoe shapers is also disclosed herein. The pair of wearable shoe shapers includes a left and a right wearable shoe shapers, substantially as described above, and configured for a left foot and a right foot, respectively.

BRIEF DESCRIPTION OF THE DRAWINGS

FIGS. 5A-D are various views of a wearable shoe shaper for a right foot, according to one embodiment of the disclosure.

DETAILED DESCRIPTION

The present disclosure relates to a shoe shaper or pair of shoe shapers that may be worn by a user while wearing a pair of shoes. In particular, each wearable shoe shaper is a complex contoured sheet configured to fit over a user's foot in a front portion of the shoe. Each wearable shoe shaper includes one or more features related to style, performance and/or comfort. For example, each wearable shoe shaper may be an open ended insert with elongated wings along sidewall, extending approximately past the ball of the foot, allowing one's foot to rest on the insole, and the insert (wearable shoe shaper) rests (inside) below the top layer of material forming the shoe. Notably, the insert does not wrap around the heel.

The wearable shoe shapers when placed within a shoe may prevent or at least inhibit the front area of the shoe (e.g., vamp and/or toe cap) from creasing the material above the user's toes, and creating a used look to the shoe. Thus, the wearable shoe shaper may be used to help keep a new pair of shoes looking new. Further, the wearable shoe shaper may be designed to be worn in a pair of shoes to prolong the aesthetic and crisp appearance, and even life of the shoe.

In addition, the user may simultaneously place his foot inside the shoe to also wear and use the shoe. When inserted into a shoe, the wearable shoe shapers' elongated wings create structural support of the inner sidewalls of the front roof toe cap portion of a shoe by occupying the space between the insole of the lower of a shoe and the inner top side of the upper of a shoe. By using the shoe shaper (during shoe use and/or during storage), the user may preserve or at least extend the "like new" appearance of the shoe and potentially prolonging its' life.

In addition, in shoes where creasing has already occurred, typically a leather or patent leather type material, the shoe shaper(s) may help the previous appearance be restored by providing semi-flexible structural integrity to the material of the front, top, and sides of a shoe, for example, by reinforcing the sidewalls and creating a flat, non-moveable surface on the material above the toes. In this way, wearable shoe shapers may restore the creased shoes, or at least reduce the "creased and used" look of the front of the shoe, maintaining a new look for much longer period than the normal "like new" appearance of the life of a shoe by itself.

Figure 1:
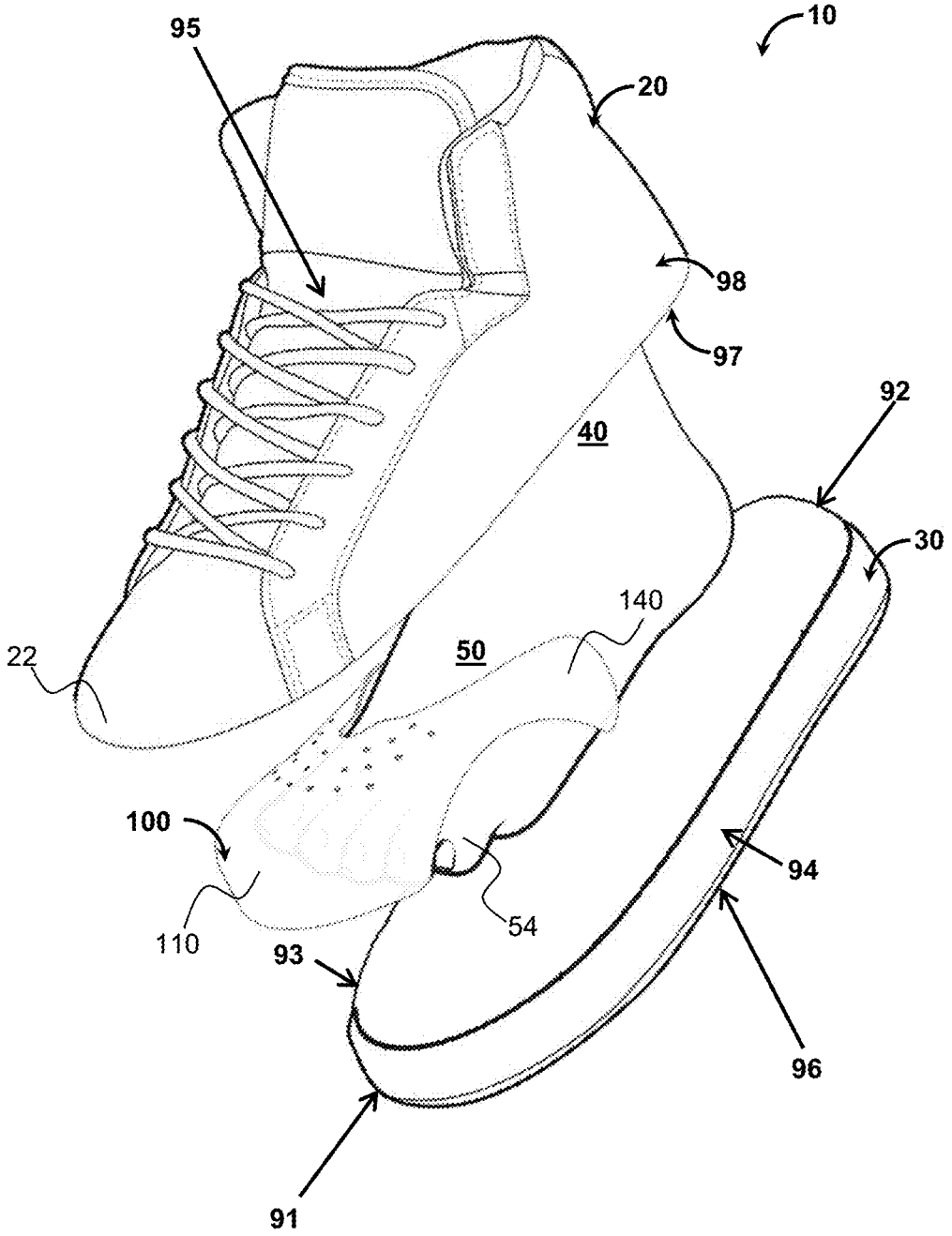
FIG. 1 is an exploded perspective view of a wearable shoe shaper in use, according to one embodiment of the disclosure.
Figure 2:
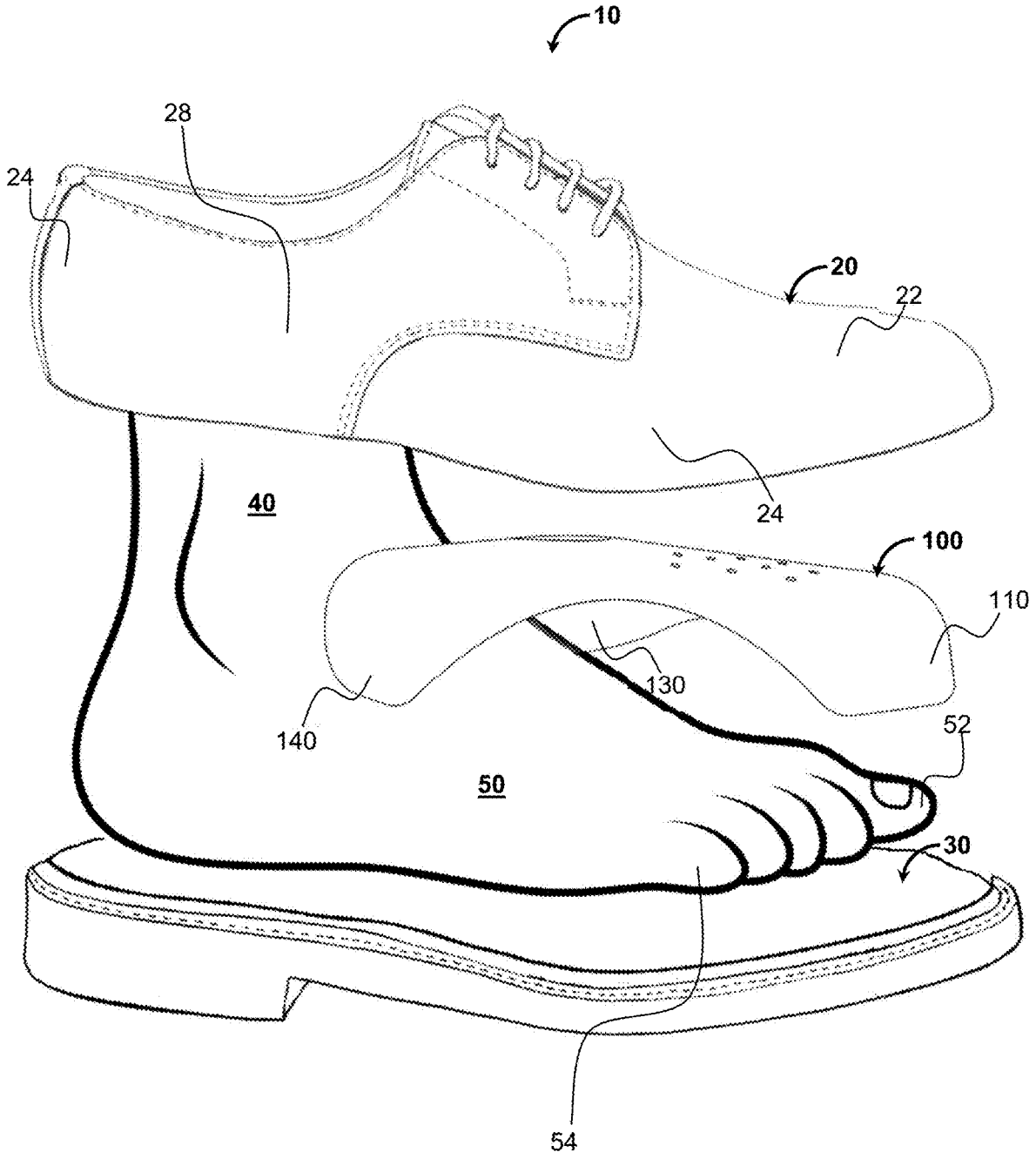
FIG. 2 is an exploded side view of a wearable shoe shaper in use, according to one embodiment of the disclosure.

FIG. 1 is an exploded perspective view of a wearable shoe shaper in use with a sneaker, according to one embodiment of the disclosure. FIG. 2 is an exploded side view of a wearable shoe shaper in use a dress shoe, according to one embodiment of the disclosure. As shown, a wearable shoe shaper 100 may be used with many types of shoes 10 particularly shoes prone to creasing (e.g., sneakers, dress shoes, boots, etc.).

As above, the wearable shoe shaper 100 may be used while the shoe 10 is worn on the foot 50 of the user 40. As shown, in use, the wearable shoe shaper 100 may cover a front portion of the foot 50 of the user 40 and may seat into the inside 97 of the shoe 10.

For reference and as commonly understood, the shoe 10 may generally be made of an upper 20 and a lower 30, as discussed above. In particular, the upper 20 may include a toe cap 22, a heel 24, a vamp 26, and a quarter 28. Also, the shoe 10 may generally define directions associated with a front 91, a back 92, an inner side 93, an outer side 94, a top 95, a bottom 96, an inside 97, and an outside 98 of the shoe 10. Also for reference and as generally understood, a human foot 50 includes a first ("big") toe 52 on the inner side 93 and a fifth ("small" or "pinky") toe 54 on the outer side 94. It should be further understood that the provided general terminology is provided here for reference and description only, and that other terminology, reference directions, and even variations to shoe construction are widely used.

The wearable shoe shaper 100 may include a toe box 110, an inner wing 130, and an outer wing 140, together configured to fit inside the shoe between the foot 50 of the user 40 and the shoe upper 20 when worn. The wearable shoe shaper 100 may be configured to conform to asymmetrical shapes and dimensions of one of a left human foot or a right human foot. Further, the wearable shoe shaper 100 may be removable from the shoe 10, rather than being a permanent fixture. In this way a single pair of wearable shoe shapers 100 may be used with multiple pairs of shoes 10.

When inserted into the shoe 10, the elongated wings (i.e., inner wing 130 and outer wing 140) of the wearable shoe shaper 100 create a structural support of the inner sidewalls of the front roof portion (e.g., toe cap 22 and vamp 26) of the shoe 10 by occupying the space, along the edge, between an insole of the lower 30 of the shoe 10 and the inner top side of the upper 20 of the shoe 10. In particular, the front portion of the wearable shoe shaper 100 (i.e., toe box 110 and portions of the inner wing 130 and the outer wing 140) provides support to the entire roof of the inside of the toe cap 22 and portions of the vamp 26 of the shoe 10. This support may inhibit or prevent material of the upper 20 of the shoe 10 from creasing or folding as the user 40 takes a step, thereby preserving the shape, and new appearance of the front 91, and top 95 of the front 91 of the shoe 10.

The wearable shoe shaper 100 may be either worn with the shoe 10 while using them to walk, or placed inside of the shoe 10 to remain inside while the shoe 10 is not being worn. Notably, the wearable shoe shaper 100 is not intended for use during athletic activities nor to provide safety of the foot like a steel toe. As such, the wearable shoe shaper 100 may be made of materials of sufficient strength to at least inhibit creasing but flexible enough to deform/reform into different shaped shoes. According to one embodiment, the wearable shoe shaper 100 be made of a flexible sheet of a thickness that provides for comfortable walking and wear in general.

Further, the wearable shoe shaper 100 may be dynamic in that it may have a flatter disposition in its free state, but may deform more into the shape of the inside 97 of the shoe 10 during use. In particular and as discussed further below, the shoe shaper 100 may be made of complex contour winged sheet sufficiently thin to bend, flex, or otherwise conform to the shoe 10. Beneficially, this flexibility and thus thickness may both inhibit creasing of the vamp 26 and toe cap 22 areas of the shoe 10, and inhibit the internal movement of the wearable shoe shaper 100 within the shoe 10. Further, due to the flexibility and dynamic re-shaping as the shoe shaper 100 is inserted into the shoe 10, it may bow outward once installed such that pressure is exerted to the interior walls of the shoe, and away from the foot 50 of the user 40, thus providing better performance and comfort.

Figure 3A:
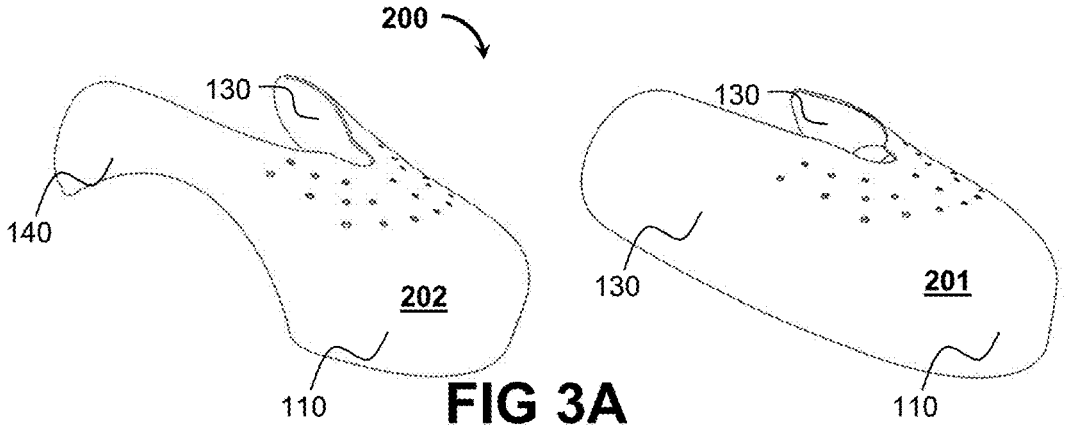
FIGS. 3A-D are various perspective views of a pair of a wearable shoe shapers according to one embodiment of the disclosure.
Figure 3B:
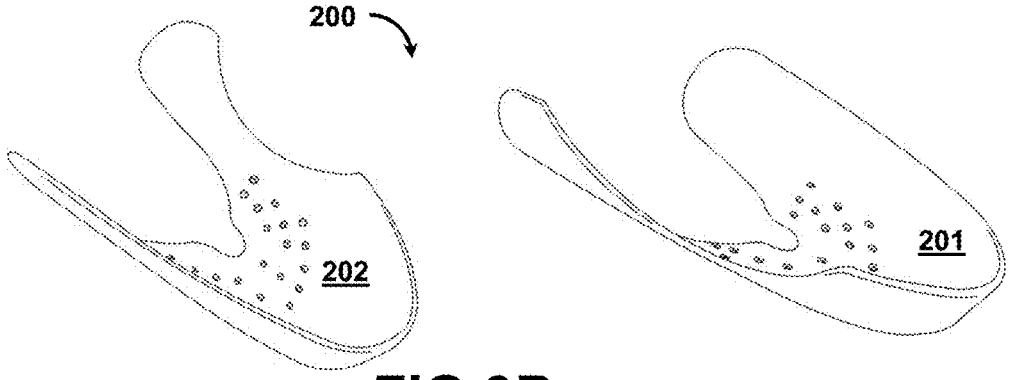
Figure 3C:
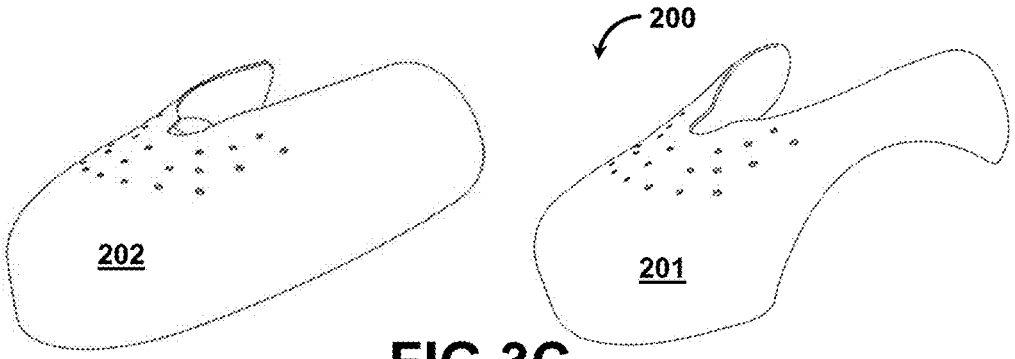
Figure 3D:
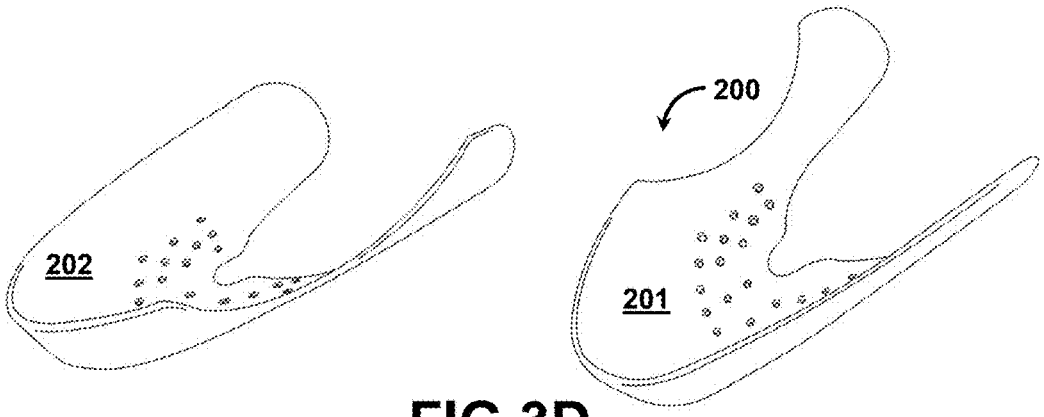
Figure 4B:
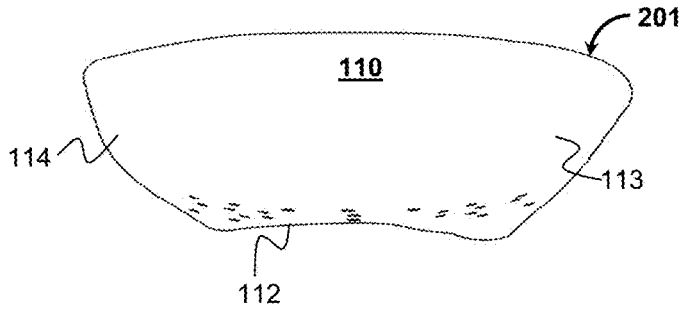
FIGS. 4A-D are various views of a wearable shoe shaper for a left foot, according to one embodiment of the disclosure.
Figure 4C:
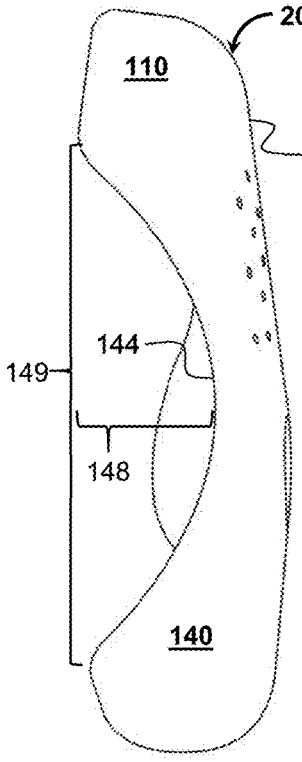
Figure 4A:
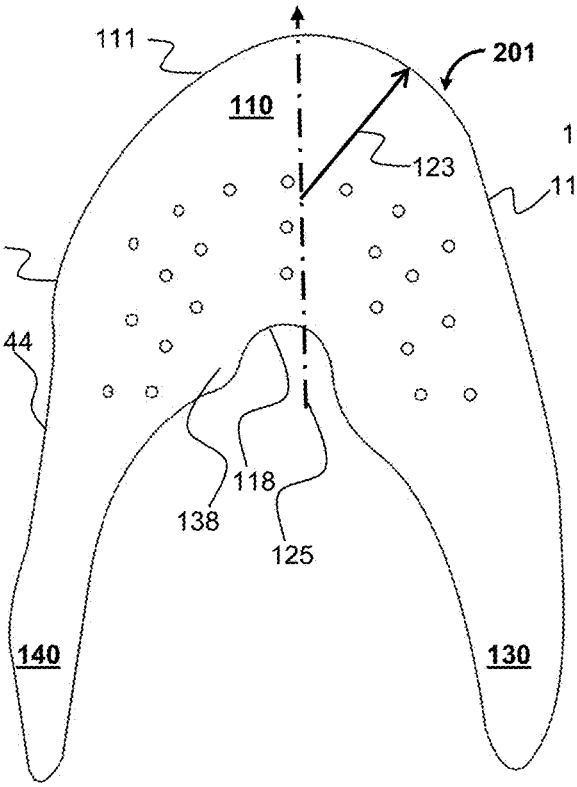
Figure 4D:
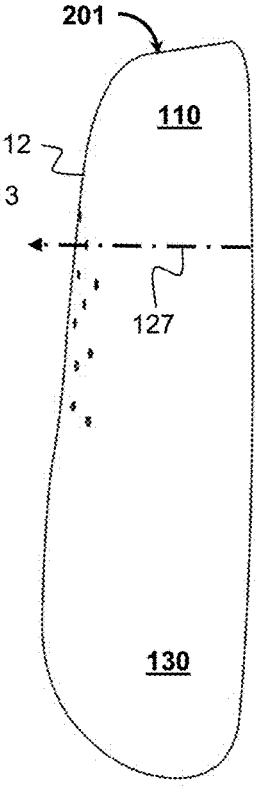

FIGS. 3A-D are various perspective views of a pair of a wearable shoe shapers according to one embodiment of the disclosure. In particular, FIG. 3A is an upper-right perspective view, FIG. 3B is a lower-left perspective view, FIG. 3C is an upper-left perspective view, and FIG. 3D a lower-right perspective view. As shown, a pair of wearable shoe shapers 200 may include a left wearable shoe shaper 201 and a right wearable shoe shaper 202. The left wearable shoe shaper 201 and the right wearable shoe shaper 202 may be substantially similar, differing only in handedness. For example, the description of the features of the wearable shoe shaper 100 may apply equally to the left wearable shoe shaper 201 (as in FIG. 1) and/or the right wearable shoe shaper 202 (as in FIG. 2).

As above, each of the left wearable shoe shaper 201 and the right wearable shoe shaper 202 may be a complex contour winged sheet. In particular, the left wearable shoe shaper 201 and the right wearable shoe shaper 202 may each include a toe box 110, an inner wing 130, and an outer wing 140, each component having its own unique structure and features. According to one embodiment, the toe box 110, the inner wing 130, and the outer wing 140 may each be formed from independent contoured sheets coupled together. Preferably, the toe box 110, the inner wing 130, and the outer wing 140 may be formed from a single contoured sheet, albeit complex, contoured sheet.

As above, the wearable shoe shaper 100 is not intended for athletic activities nor foot safety, and thus may be made of materials of sufficient strength to at least inhibit creasing but flexible enough to deform/reform into different shaped shoes. In particular, the wearable shoe shaper 100 may be thought of as a structural roof and sidewall support made of a soft, or rigid, material that prevents the roof or sidewall(s) of the front area (e.g., toe cap 22 and vamp 26) of the upper 20 of one or more shoes 10, from creasing or wrinkling when a step is taken while the shoe is being worn. Further, the wearable shoe shaper 100 may be understood to be a spring loaded sheet retained in place and shape by portions of an interior surface of the shoe upper 20.

According to one embodiment, the pair of wearable shoe shapers 200 may be made of plastic, or the like. In particular, the pair of wearable shoe shapers 200 may be two contoured plastic sheets shaped into two wearable shoe shapers 100, each having a symmetrical shape that mirrors the other. Each wearable shoe shaper 100 may define a structural roof and sidewall support (insert) made of a soft, or rigid, plastic sufficiently strong to prevent or inhibit the roof and sidewalls or front area of the shoe from creasing or wrinkling when a step is taken. Further, different types of plastic or resin can be used to produce the wearable shoe shaper 100 for comfort versus durability. For example, the wearable shoe shaper 100 may be made in a lightweight option to preserve shoe shape during travel. According to one embodiment, the plastic (or equivalent material) may be non-porous to avoid absorbing moisture or developing odors. It is understood that different molecular plastics (or equivalents) are may be selected based on particular use or preferences of softness over rigidity.

According to one embodiment, the wearable shoe shaper 100 may be made using a plastic injection molding method. For example, the wearable shoe shaper 100 may be made based off of a particular shoe or a generic shoe, where a clay mold is created by removing the inner pieces of sneaker material and filled with clay. The sneaker material is removed and the clay shaped to perfection. After drying, a 3D image may be taken and uploaded for final modification to complete the mold making process for use in plastic injection. A steel set of tools (e.g., die) are made from a 3D file created from the clay mold. Alternately, the wearable shoe shaper 100 (or components used the injection molding process) may be made using a 3D printing method.

Figure 14B:
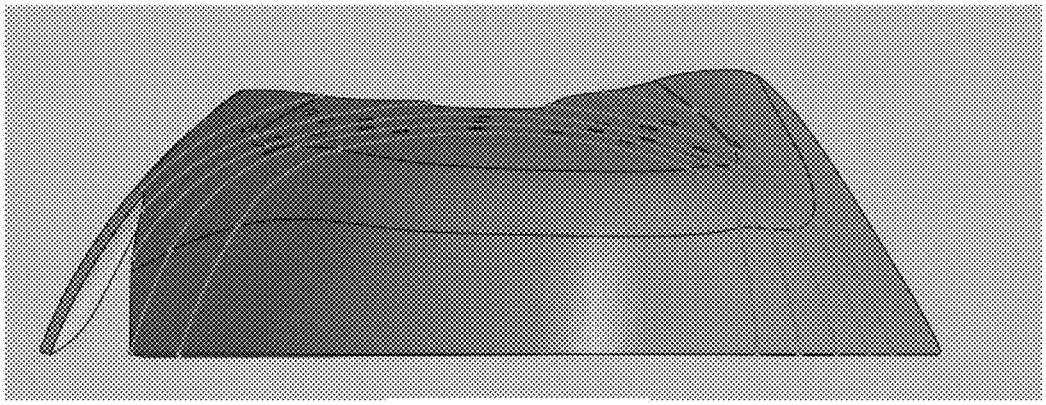
FIGS. 14A-B are top and front views of a wearable shoe shaper for a right foot, according to one embodiment of the disclosure.
Figure 14A:
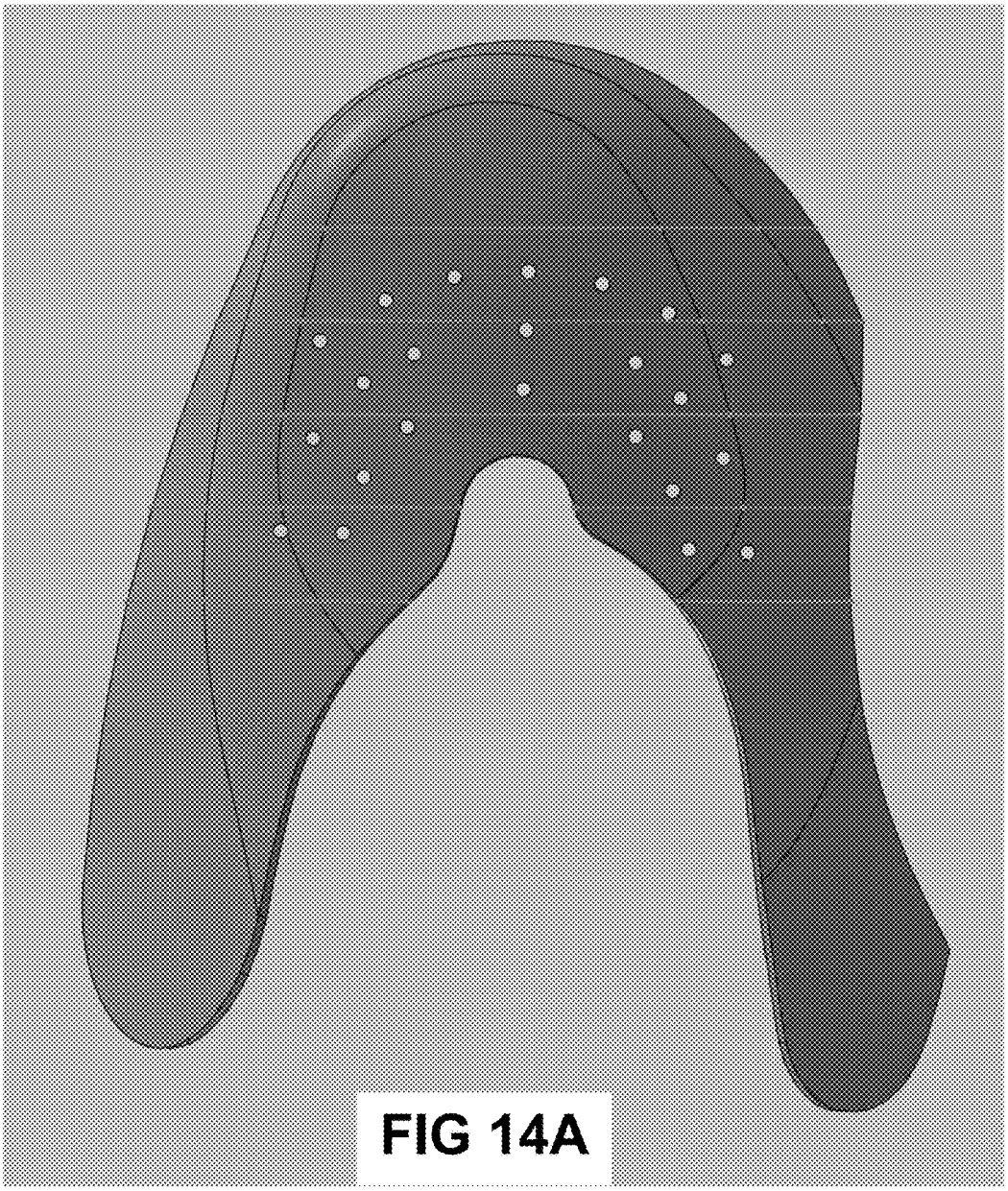

According to one embodiment, the wearable shoe shaper 100 may be made in layers of sheets coupled together or otherwise made in stages. For example, as shown in FIGS. 14A and 14B, the wearable shoe shaper 100 may be made in three "topographical layers" (e.g., discrete layers delineated by the black reference lines shown) along that are subsequently coupled together or otherwise combined into a single contoured sheet. This may provide for ease of manufacture given the complexity of the contoured sheet.

Whether made as a combination of coupled sheets or a unitary contoured sheet (or sheets), each wearable shoe shaper 100 may be configured to conform to asymmetrical shapes and dimensions of one of a left human foot or a right human foot. This may apply overall to each one of the pair of wearable shoe shapers 200, or merely to individual elements and features of each wearable shoe shaper 100.

As a whole, the left wearable shoe shaper 201 and the right wearable shoe shaper 202 are each shaped in the natural contour of the foot 10. When viewing from the front, the shape is tapered down, outwardly from the foot. For example, the left wearable shoe shaper 201 is tapered from a high point on its right above the first toe (big toe), down to a low point on its left above the fifth toe (outer/pinky toe). Inversely, and the right wearable shoe shaper 202 is tapered from a high point on its left above the first toe, down to a low point on its right above the fifth toe. Thus, as a pair they are symmetrical to each other, but on an individual basis, each wearable shoe shaper 100 is asymmetrical, thus denoted as the left wearable shoe shaper 201 and the right wearable shoe shaper 202.

Looking at the components of each individual wearable shoe shaper 100, the toe box 110 may include asymmetries relative to its longitudinal (or forward-aft) axis, reflecting the different relative lengths of human toes. Further, the toe box 110 may include reliefs and/or raised sections that reflect the foot's bone/muscle/tendon structure at the top inner side of the foot. While, inclusion of the asymmetries will limit each wearable shoe shaper 100 to a left or right "handedness", they may provide the benefit of greater comfort and improved performance over a symmetric wearable shoe tree.

According to one embodiment, the top of wearable shoe shaper 100 may be tapered along the top arch of the foot allowing a "range of motion" that doesn't impede a user's normal "step". In particular, the inner wing 130 and/or the toe box 110 may have one or more raised sections and/or higher inner elevations that reflect the greater height of the foot's bone structure on its inner side, compared to its outer side.

Similarly, the outer wing 140 may include a vacancy configured to let the fifth or "pinky toe" to expand through it (as discussed further below). For example, the outer wing 140 may have a curve or arch shape cut out of it/built into it, such that the outer side of the foot may expand therethrough when worn. This vacancy should be positioned over the fifth toe when worn, providing for the expansion of the foot (e.g., the fifth toe) through the curved area when worn.

FIG. 4A-4D are various views of a wearable shoe shaper for a left foot, according to one embodiment of the disclosure. FIG. 5A-5D are various views of a wearable shoe shaper for a right foot, according to one embodiment of the disclosure. In both sets of views, the wearable the shoe shaper are slightly rotated to better show features such as smoothly curved corners, continuous contours, etc. As above in FIG. 1, the left wearable shoe shaper 201 and the right wearable shoe 202 may each include the toe box 110, the inner wing 130, and the outer wing 140. Also as above, the shoe 10 may define the directions of front 91, back 92, inner side 93, outer side 94, top 95, bottom 96, inside 97, and outside 98.

According to one embodiment the toe box 110 may be ventilated. In particular and with reference to FIG. 5A, the toe box 110 may include a plurality of ventilation holes 116 passing through the contoured sheet. For example the plurality of ventilation holes 116 may include on the order of 25 holes. Also for example, the plurality of ventilation holes 116 may each have a diameter of between 0.03 inch and 0.125 inch. Advantageously, the plurality of ventilation holes 116 may provide for ventilation and breathability of the user's foot through the contoured sheet.

Through extensive testing, and trial and error, the inventors have discovered that, in addition to the individual elements and their features, their combination together may provide improved performance and comfort. As above, the wearable the shoe shaper 100 may be configured to fit inside the shoe between a foot of the user and the shoe upper when worn, and further configured to conform to asymmetrical shapes and dimensions of one of a left human foot or a right human foot. Further, the top of the shoe shaper 100 may be tapered along the front top arch of the foot, allowing for a "range of motion" while not impeding the wearer's normal "step". In particular, the wearable shoe shaper 100 may slope upward in the direction from the front to the back. This upward slope may be integrated into the toe box 110, the inner wing 130, the outer wing 140, or any combination thereof.

Figure 13B:
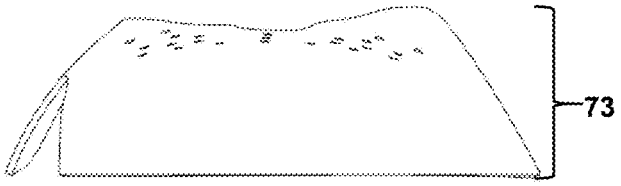
FIGS. 13A-E are various views of a wearable shoe shaper for a right foot, according to one embodiment of the disclosure.
Figure 13D:
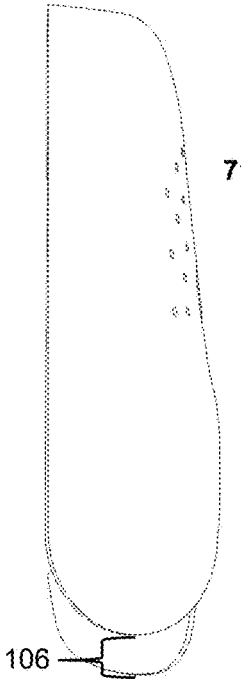
Figure 13A:
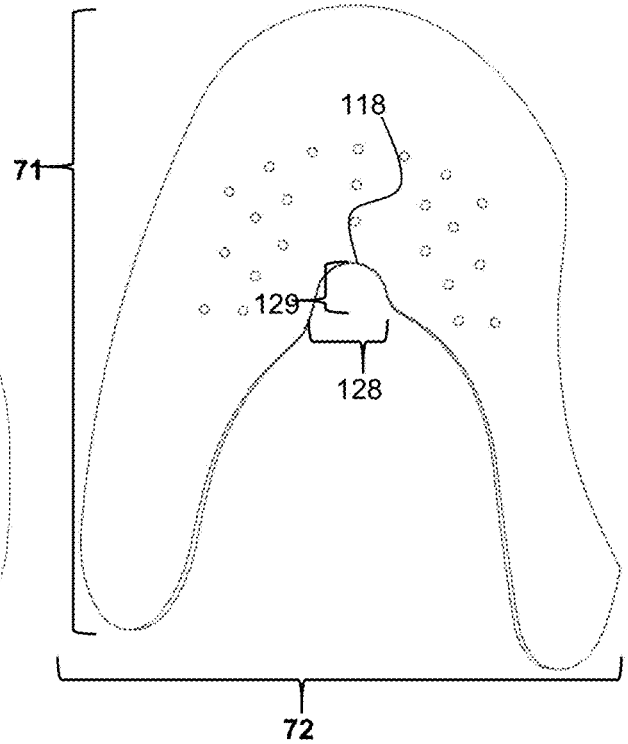

According to one embodiment, the wearable the shoe shaper 100 may be sized and dimensioned optimally for use with several standard shoe types and sizes. In particular, the wearable the shoe shaper 100 may be sized and dimensioned for a rectangular volumetric envelope (see e.g., FIGS. 13A and 13B, showing an envelope length 71, an envelope width 72, and an envelope height 73) having a base of 6 inches long (front-to-back) by 5 inches wide (inner side-to-outer side), and a height bottom-to-top of 2 inches tall, plus or minus 25%. In this way, a single size may be used for many adult shoes, without the need for user modification. Optionally, the wearable the shoe shaper 100 may be sized and dimensioned for other general categories of shoes, such as children's shoes, in a similar fashion.

According to one embodiment, the wearable the shoe shaper 100 may be fully customizable for use in different shoe sizes and comfort levels. In particular, the wearable the shoe shaper 100 may be made of trimmable materials, such that a user may modify its size and shape. For example, the wearable the shoe shaper 100 may be made of a plastic sheet that is thick enough to inhibit creasing, but thin enough to be cut with household scissors. While embodiments of the wearable the shoe shaper 100 may fit in a wide variety of shoes, here, the wearable the shoe shaper 100 may fit into many more styles of sneakers, dress shoes, boots, and the like by virtue of their being user-customizable.

As above, the toe box 110 may be formed of otherwise made from a contoured sheet configured to fit inside the shoe between a foot of the user and the shoe upper when worn. Structurally, the toe box 110 may have a front face 111, a top side 112, an inner side 113, and an outer side 114, relative to the shoe 10. The toe box 110 may be configured to cover at least four toes of a human foot, the toe box 110 may be further configured to conform to asymmetrical shapes and dimensions of one of a typical left human foot 50 or a typical right human foot 50.

Generally, the toe box 110 may have a "boxy" shape as opposed to a "pointy" shape. In particular, the toe box 110 may be configured to substantially match (i.e. be substantially similar in size and shape) or otherwise mate flat against the inside surfaces of the toe cap 22 of the shoe 10. In this way, the toe box 110 may substantially fill in the entire toe cap of the shoe, and thereby prevent any soft or otherwise unsupported areas at the toe cap 22 of the shoe 10. Further, the "boxy" toe box 110 may work with a variety of shoes.

As above, the toe box 110 may be configured to conform to asymmetrical shapes and dimensions of one of a left human foot or a right human foot. For example, according to one embodiment and referring to FIG. 4A, the toe box 110 may be shaped to include an asymmetrically curved front face 111, relative to a longitudinal axis 125 (i.e., back-to-front and centered in the toe box 110). In particular and as shown (e.g., FIG. 4D), the front face 111 of the toe box 110 may be substantially vertical relative to the lower 30 of the shoe 10, and may have a variable radius of curvature 123 (see ref., FIG. 4A) that varies from its inner side 113 to its outer side 114, as measured about a vertical axis 127 (see ref., FIG. 4D) centered in the toe box 110.

According to another embodiment, variable radius of curvature 123 of the asymmetrically curved front face 111 may remain substantially constant (e.g., less than 10% change) from the inner side 113 of the toe box 110 to the longitudinal axis 125 as measured about a vertical axis 127, may decrease slightly (e.g., 5%-15% change) between the longitudinal axis 125 to an angle substantially 45 degrees from the longitudinal axis 125 as measured about a vertical axis 127, and then progressively increase until reaching the its outer side 114 of the toe box 110 as measured about a vertical axis 127.

According to yet another embodiment, the front face 111 of the toe box 110 may be a complex curve, reflecting an average or common positioning and shape of toes on a foot. For example, the front face 111 may begin as a linear portion that extends from the inner side 113 (and/or the inner wing 130), which then converts to a convex curve having a progressively increasing curvature as it wraps around the front of the toes, and which terminates at the outer side 114 (and/or the outer wing 140) as either curved or linear portion.

According to one embodiment, the top side 112 of the toe box 110 may be substantially horizontal (relative to the lower of shoe), and the front face 111 of the toe box 110 may be substantially vertical (relative to the lower of shoe), with a curved section 115 smoothly joining the top side 112 and the front face 111 of the toe box 110 (see ref., FIGS. 5B-D). The curved section 115 may have a radius of curvature of approximately 0.5 inch plus/minus 0.25 inch.

Figure 6:
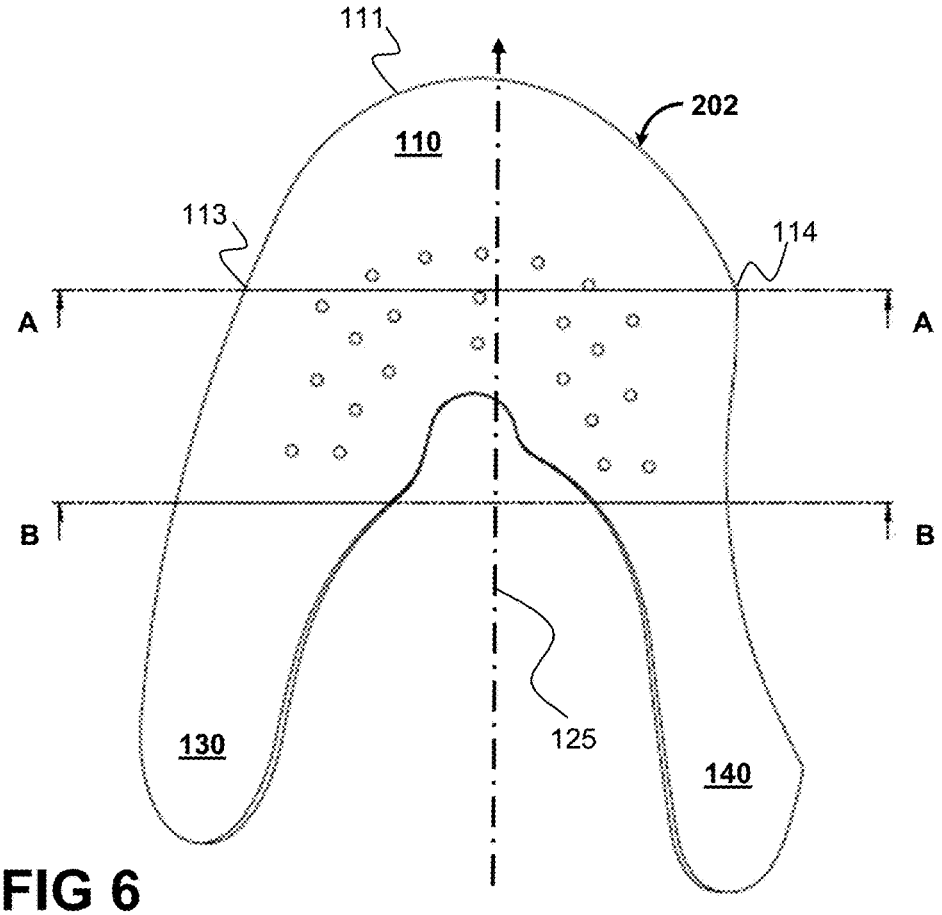
FIG. 6 is a top view of a wearable shoe shaper for a right foot, according to one embodiment of the disclosure.
Figure 7A:
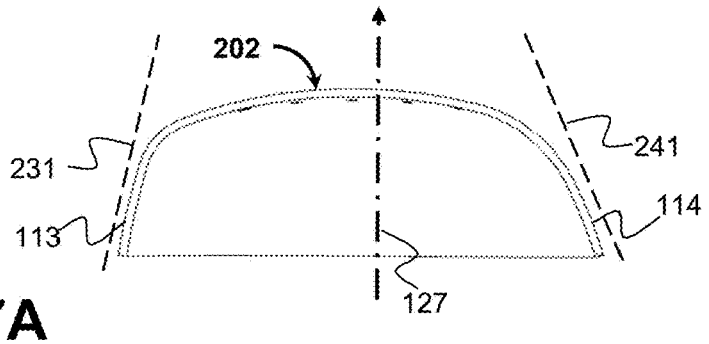
FIG. 7A is a cutaway view of the wearable shoe shaper of FIG. 6 along line A-A, according to one embodiment of the disclosure.
Figure 7B:
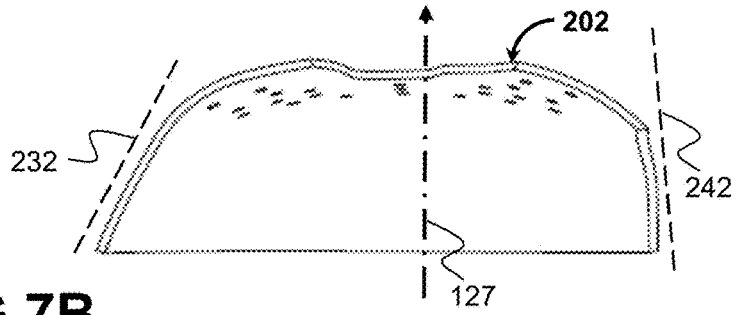
FIG. 7B is a cutaway view of the wearable shoe shaper of FIG. 6 along line B-B, according to one embodiment of the disclosure.

FIG. 6 is a top view of a wearable shoe shaper for a right foot, according to one embodiment of the disclosure. FIG. 7A is a cutaway view of the wearable shoe shaper of FIG. 6 along line A-A, according to one embodiment of the disclosure. FIG. 7B is a cutaway view of the wearable shoe shaper of FIG. 6 along line B-B, according to one embodiment of the disclosure. As above, the right wearable shoe 202 may include the toe box 110, the inner wing 130, and the outer wing 140. Also as above, the toe box 110 may have a "boxy" shape as opposed to a "pointy" shape. For reference, the complex curvature and boxiness of the toe box 110 may be encompassed and generally described using averaged inclination lines 231, 232, 241, and 242 at the section cuts.

As above, it is understood that the toe box 110 (as well as the inner wing 130 and the outer wing 140) may be made from a complex contoured sheet, and further, the reference marks referred to herein (e.g., section cut, axes, transitions, etc.) are not limiting, but rather are for purposes of general explanation. As such, cutaway line B-B may generally indicate a transition area or an aft end of the toe box 110, and cutaway line A-A (along with longitudinal axis 125) may generally indicate a longitudinal and latitudinal center of the toe box 110.

As above, the front face 111 of the toe box 110 may be substantially vertical relative to the lower 30 of the shoe 10, with the curved section 115 smoothly joining the front face 111 and the top side 112 of the toe box 110. According to one embodiment, the inner side 113 and the outer side 114 of the toe box 110 may also be substantially vertical (relative to the lower of the shoe) as well, with the curved section 115 similarly joining the inner side 113 and the outer side 114 to the top side 112, in addition to the front face 111 of the toe box 110. Here, "substantially vertical" and "substantially horizontal" are defined as having an inclination of to up to 10 degrees from true.

In other embodiments, the front face 111 of the toe box 110 may be inclined aft from the lower of the shoe by as much as 15 degrees from vertical, the inner side 113 of the toe box 110 may be inclined toward its outer side from the lower of the shoe by as much as 20 degrees from vertical (see e.g., inclination lines 231 and 232), and the outer side 114 of the toe box 110 may be inclined toward its inner side from the lower of the shoe by as much as 25 degrees from vertical (see e.g., inclination lines 241 and 242), while the wearable the shoe shaper 100 is not in the shoe (or otherwise in its free state).

Advantageously, by flattening the toe box 110 or otherwise forming the top, the front, the inner side, and the outer side as generally orthogonal (i.e., 90 degrees plus/minus 10 degrees) to each other and the lower of the shoe, the volume available inside of the toe box 110 is maximized, making more room available for the wearer's toes. This may accommodate a greater variety of foot shapes, as well as making the shoe shaper 100 more comfortable to the user in general. Additional modifications of the toe box 110 may include specifically forming it for different styles of shoes. For example, toe box 110 may be modified from the more "boxy" shape to better match or otherwise mate with different shoes having rounded, low, square and tall shapes.

Referring back to FIGS. 4A-5D, the inner wing 130 may be formed from a contoured sheet (separate or the same as the toe box 110). The inner wing 130 may extend backward from the top side 112 and the inner side 113 of the toe box 110. For reference, an exemplary toe box-inner wing delineation 121 is provided in FIGS. 5A and 5C. However, said delineation is merely for clarity of explanation, as each component may be made from the same contoured sheet, and as discussed above, may transition over a common or otherwise shared transition region.

According to one embodiment, the inner wing 130 may extend aft to a region of an arch of the foot 50. For example, the inner wing 130 may extend aft to the beginning (i.e., front end) of a wearer's arch. Alternately, for example, the inner wing 130 may extend aft to the middle or midpoint of a wearer's arch. Alternately, for example, the inner wing 130 may extend aft to the end (i.e., aft end) of a wearer's arch.

According to one embodiment, the inner wing 130 may include an inner foot interface 132 configured to rest alongside, across, and/or against an inner side of the human foot, proximate a first metatarsal bone of the human foot. For example, and as shown the inner foot interface 132 may be embodied as a smooth, curved termination of the inner wing 130 on its upper side.

The outer wing 140 may be formed from a contoured sheet (separate or the same as the toe box 110 and/or the inner wing 130). The outer wing 140 may extend backward from the top side 112 and the outer side 114 of the toe box 110. For reference, an exemplary toe box-outer wing delineation 122 is provided in FIGS. 5A and 5D. However, said delineation is merely for clarity of explanation, as each component may be made from the same contoured sheet, and as discussed above, may transition over a common or otherwise shared transition region.

According to one embodiment, the outer wing 140 may extend aft to a region of an arch of the foot 50. For example, the outer wing 140 may extend aft to the beginning (i.e., front end) of a wearer's arch. Alternately, for example, the outer wing 140 may extend aft to the middle or midpoint of a wearer's arch. Alternately, for example, the outer wing 140 may extend aft to the end (i.e., aft end) of a wearer's arch.

According to one embodiment, the outer wing may include an outer foot interface 142 configured to rest alongside, across, and/or against an outer side of the human foot proximate a fifth metatarsal bone of the human foot. For example, and as shown the outer foot interface 142 may be embodied as a smooth, curved termination of the outer wing 140 on its upper side.

Preferably, the wearable shoe shaper 100 may rest on the lower of the shoe around a perimeter of the foot. In particular, the toe box 110, the inner wing 130, and the outer wing 140 may rest against the lower of the shoe in a substantially vertical orientation or otherwise, but without wrapping underneath the wearer's foot, when worn. Advantageously, in this way the wearable shoe shaper 100 may remain detached or decoupled from the lower, and the wearer's foot will not be "captured" in a pocket by the wearable shoe shaper 100 under his own weight.

Figure 8:
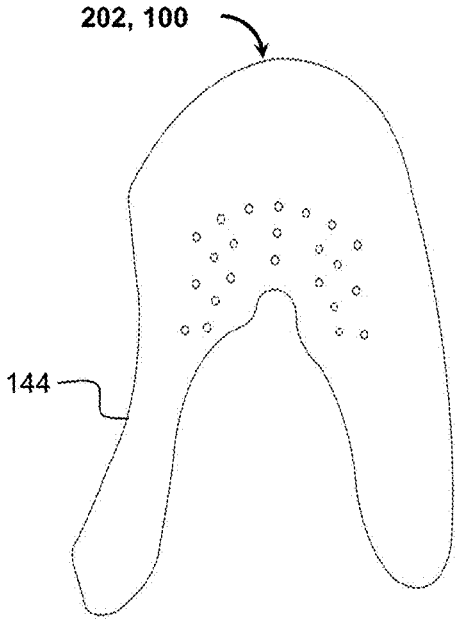
FIG. 8 is a bottom view of a wearable shoe shaper for a right foot, according to one embodiment of the disclosure.
Figure 9:
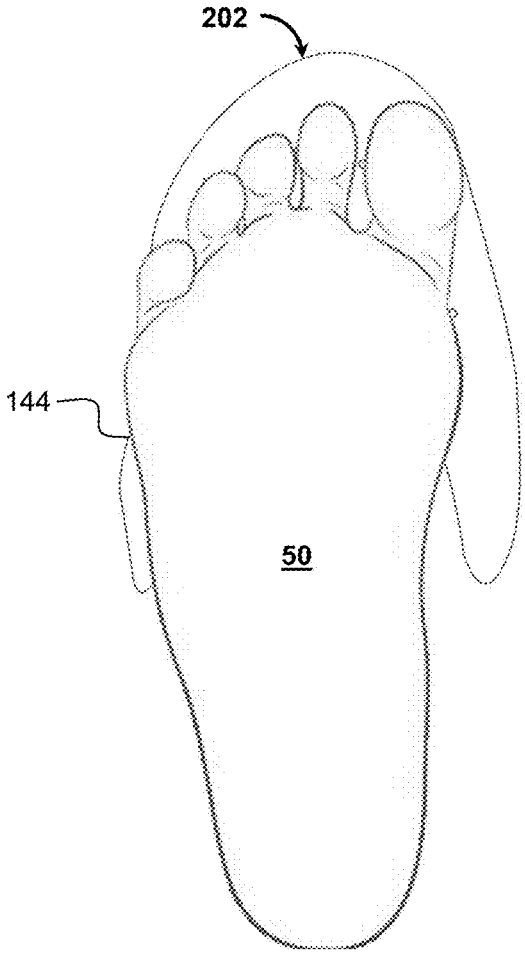
FIG. 9 is a bottom view of the right wearable shoe shaper of FIG. 8 being worn, according to one embodiment of the disclosure.

FIG. 8 is a bottom view of a wearable shoe shaper for a right foot, according to one embodiment of the disclosure. FIG. 9 is a bottom view of the right wearable shoe shaper of FIG. 8 being worn, according to one embodiment of the disclosure. One key differentiator between the inner wing 130 and the outer wing 140 is that the outer wing 140 may be further configured for outward foot expansion. This outward foot expansion may be static (i.e., based on different foot sizes) or dynamic (i.e., based on the foot spreading laterally under user weight during walking), thus providing both greater user versatility and comfort.

According to one embodiment, the outer wing 140 may include an expansion port (a fifth toe vacancy 144). In particular and as above, the outer wing 140 may include a vacancy configured to let the fifth or "pinky toe" to expand through. For example, the fifth toe vacancy 144 may include or be defined as a curve or arch shape cut out of the outer wing 140 or built into the outer wing 140, such that the outer side of the foot may expand there through when worn. The fifth toe vacancy 144 may be positioned over the fifth toe when worn, providing for the expansion of the foot (e.g., the fifth toe or portions thereof) through the curve when worn (see e.g., FIG. 9).

Advantageously, any deterioration in performance related to inhibiting creases is mitigated, as there is general less creasing and more foot expansion on fifth toe side of the foot, particularly as the first toe side of the foot is typically fixed in place, being the location of the majority the walker's weight. Further, this arrangement is optimized for nature dynamic expansion due to the "pinning" of the first toe due to the wearer's weight.

Figure 13E:
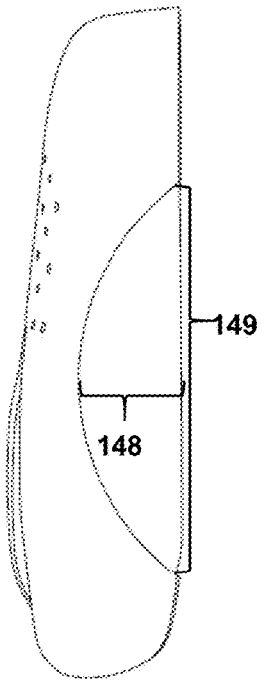

According to one embodiment, the outer wing 140 may be configured to provide for foot expansion during walking and/or for oversize feet. In particular, the outer wing 140 may be include a fifth toe vacancy 144 or expansion section that is configured to ride above the fifth toe 54 during wear (see also FIGS. 1, 7, and 9) or otherwise expose the fifth toe 54 as viewed from the outer side 94. Preferably, and as illustrated, the fifth toe vacancy 144 is defined by a curved discontinuity between the toe box 110 and the outer wing 140. According to one embodiment, the fifth toe vacancy 144 may have a maximum bottom-to-top height 148 (FIG. 13E) between 0.5 inch and 1.5 inches, and a maximum front-to-back length 149 (FIG. 13E) between 1.0 inch and 4.5 inches. According to one embodiment, the curved discontinuity defining the fifth toe vacancy 144 may have a maximum bottom-to-top height 148 of approximately 1 inch, and a maximum front-to-back length 149 of 3 inches. According to one embodiment, the outer wing 140 may be longer than the inner wing 130. In particular, the outer wing 140 and the inner wing 130 may have an outer to inner wing length differential 106 of approximately 0.5 inch (+/−0.3) (FIG. 13D).

Figure 10:
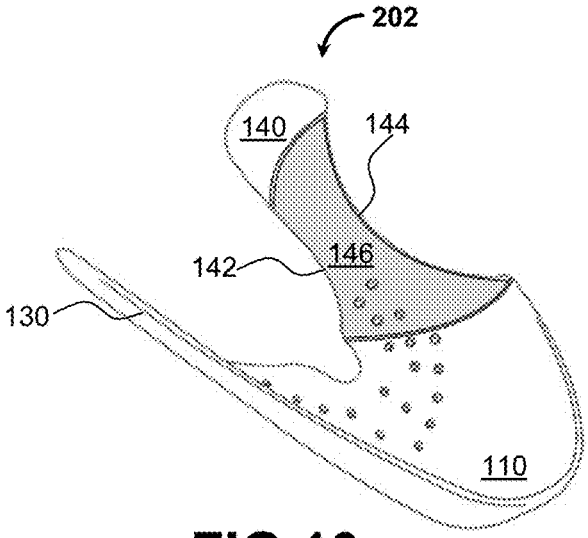
FIG. 10 is a bottom perspective view of the right wearable shoe shaper of FIG. 8 including a cutaway portion, according to one embodiment of the disclosure.

FIG. 10 is a bottom perspective view of the right wearable shoe shaper of FIG. 8 including a cutaway portion, according to one embodiment of the disclosure. Here, contoured sheet is generally of a single or common sheet thickness, however, the shaded area represents an area of additional sheet thickness (i.e., showing the common sheet thickness removed).

According to one embodiment, the outer wing 140 may include a reinforced portion 146. In particular, reinforced portion 146 is an area of increased thickness above the fifth toe vacancy 144 (illustrated as the arched or otherwise curved lower portion of the outer wing 140). The reinforced portion 146 may be configured so as to strengthen that area, and decrease the potential for breaking in that area (i.e., the reinforced portion 146) by having more material there. For example, the fifth toe vacancy 144 may be further defined by the reinforced portion 146 extending backward from the toe box about the curved discontinuity of the outer wing 140. The reinforced portion 146 may be limited to of the outer wing 140 or may include portions of the toe box 110. The reinforced portion 146 may have a reinforced sheet thickness at least 10% greater than a sheet thickness of a non-reinforced portion of the contoured sheet.

Figure 13C:
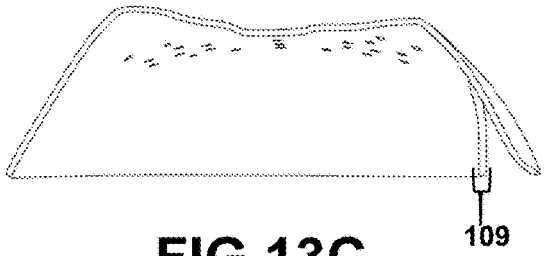

According to one embodiment, wherein the toe box 110, the inner wing 130, and the outer wing 140 may be formed from a single contoured sheet made of plastic and having a sheet thickness 109 (ref. e.g., FIG. 13C), and the outer wing 140 may include the reinforced portion 146. Here, the sheet thickness 109 of the non-reinforced portion of the contoured sheet may be between 0.47 inch and 0.094 inch, and the sheet thickness 109 of the reinforced portion 146 of the outer wing 140 may be between 15% and 25% greater than the sheet thickness of the non-reinforced portion of the contoured sheet. It is understood that sheet thickness may vary with the material of the single contoured sheet.

Figure 11:
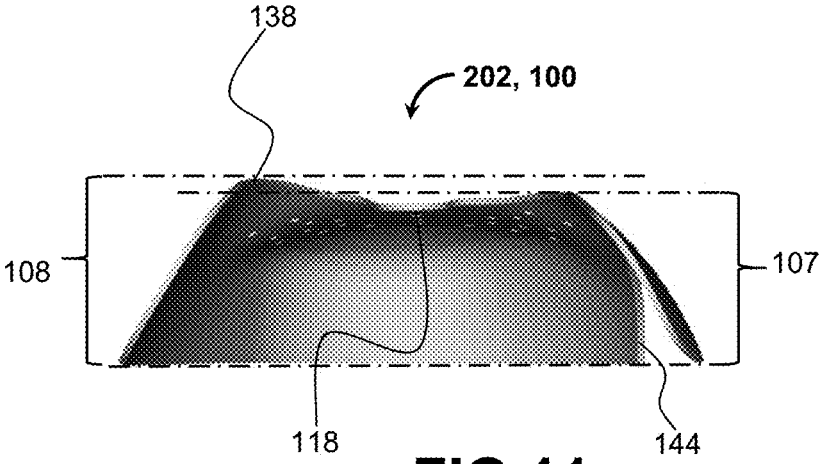
FIG. 11 is a back view of a wearable shoe shaper for a right foot, according to one embodiment of the disclosure.
Figure 12:
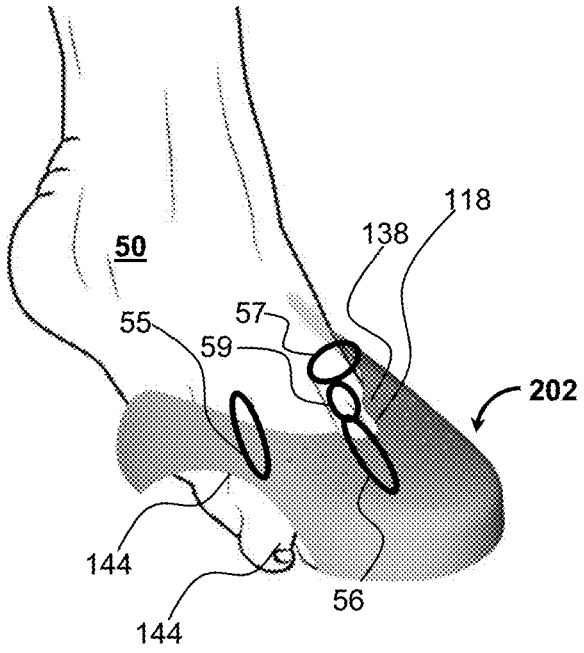
FIG. 12 is a top perspective view of a wearable shoe shaper for a right foot, according to one embodiment of the disclosure.

FIG. 11 is a back view of a wearable shoe shaper for a right foot, according to one embodiment of the disclosure. FIG. 12 is a top perspective view of a wearable shoe shaper for a right foot, according to one embodiment of the disclosure. As above, the toe box 110 may be configured to conform to asymmetrical shapes and dimensions of one of a left human foot or a right human foot. Similarly, the inner wing 130 may be configured to conform to asymmetrical shapes and dimensions of one of a left human foot or a right human foot.

In general, each wearable shoe shaper 100 may include one or more features to give extra space with regard to natural bone structure of the wearer's foot, and to provide a foot comfort zone relative to the top of the foot's extreme elevated position during walking. In particular, in most feet, the area proximate the navicular bone 57 is naturally the highest area of the foot 50. Further, in most feet, the area proximate the intermediate cuneiform bone 59 forms another relatively raised point during walking. According to one embodiment, the wearable shoe shaper 100 may include an inner relief 138 and a mid-foot vacancy 118.

The inner relief 138 is generally defined as an elevated portion of the contoured sheet, positioned above a navicular bone and/or the area proximate the navicular bone 57. The inner relief 138 is arranged to generally conform to an elevated height of the navicular bone of the human foot. According to one embodiment, the inner side of each wearable shoe shaper 100 (here right wearable shoe shaper 202) may have more vertical space than the outer side, and may include the inner relief 138. In particular, the inner relief 138 may include a raised portion that is configured to provide relief to the wearer's foot in the area proximate the navicular bone 57 or is otherwise higher than the rest of the wearable shoe shaper 100. For example, the wearable shoe shaper 100 may have an inner side maximum height 108, and an outer side maximum height 107 opposite the longitudinal axis 125. The inner side maximum height 108 may be 0.75 (+/−0.25) inch greater than outer side maximum height 107. The inner relief 138 may be integrated into at least one of the toe box 110 and the inner wing 130, or both.

Similarly, the mid-foot vacancy 118 is generally defined as a recess or discontinuity in the contoured sheet at an upper back edge of the toe box 110, akin to a dimple in an otherwise continuous simple curve defining the upper back edge of the toe box 110. The mid-foot vacancy 118 is generally centered laterally (i.e., traversing the plane of the longitudinal axis 125), and configured to be positioned proximate a third metatarsal bone 56 of the human foot while standing, but re-positioned proximate intermediate cuneiform bone 59 of the human foot, and/or in the area proximate the intermediate cuneiform bone 59 during walking. In particular, the mid-foot vacancy 118 is arranged to avoid contact with the foot proximate intermediate cuneiform bone during walking. According to one embodiment, the mid-foot vacancy 118 may be further defined as having smooth transition between discontinued/recessed areas and otherwise continuous simple curve defining the upper back edge of the toe box 110 (i.e., rounded). The mid-foot vacancy 118 may have a side-to-side width 128 between 0.5 inch and 1.0 inch, and a front-to-back length 129 of 0.25 inch and 1.0 inch. The mid-foot vacancy 118 may be integrated into at least one of the toe box 110 and the inner wing 130, or both.

The above description of the various embodiments is provided to enable a person of ordinary skill in the art to make or use the subject matter of the disclosure. Various modifications to the embodiments will be readily apparent to those skilled in the art, and the generic principles defined herein may be applied to other variations without departing from the spirit or the scope of this disclosure. Thus, it is to be understood that the disclosure is not intended to be limited to the examples and designs described herein, which merely represent a presently preferred implementation of the disclosure, but that the disclosure is to be accorded the widest scope consistent with the principles and novel features disclosed herein. It is to be further understood that the scope of the present disclosure fully encompasses other embodiments that may become obvious to those skilled in the art.

The invention claimed is:

1. A wearable shoe shaper for a shoe, the shoe having an upper and a lower, said shoe defining a front direction, a back direction, an inner direction, an outer direction, a top direction, a bottom direction, an inside direction and an outside direction, the wearable shoe shaper comprising:

a toe box formed from a contoured sheet configured to fit inside the shoe between a foot of a user and the shoe upper when worn, the toe box having a top side, a front, an inner side, and an outer side, relative to the shoe, the toe box configured to cover at least four toes of a human foot, the toe box further configured to conform to asymmetrical shapes and dimensions of one of a left human foot or a right human foot;

an inner wing formed from the contoured sheet, extending backward from the top side and the inner side of the toe box, the inner wing including an inner foot interface configured to rest alongside an inner side of the human foot, proximate a first metatarsal bone of said human foot; and an outer wing formed from the contoured sheet, extending backward from the top and the outer side of the toe box, the outer wing including an outer foot interface configured to rest alongside an outer side of the human foot, proximate a fifth metatarsal bone of said human foot, the outer wing further including a fifth toe vacancy configured to expose a fifth toe of the human foot, as viewed from the outer side.

2. The wearable shoe shaper of claim 1, wherein the toe box includes a mid-foot vacancy, said mid-foot vacancy defined as a recess or discontinuity in the contoured sheet at an upper back edge of the toe box, and arranged to avoid contact with the foot proximate an intermediate cuneiform bone during walking.

3. The wearable shoe shaper of claim 2, wherein the mid-foot vacancy is configured to be positioned proximate a third metatarsal bone of the human foot while standing, but re-positioned in the area proximate the intermediate cuneiform bone during walking; and wherein the mid-foot vacancy has a side-to-side width between 0.5 inch and 1.0 inch and a front-to-back length of 0.25 inch and 1.0 inch.

4. The wearable shoe shaper of claim 1, wherein at least one of the inner wing and the toe box includes an inner relief, said inner relief defined as an elevated portion of the contoured sheet positioned above a navicular bone of the human foot, and arranged to conform to an elevated height of the navicular bone of the human foot.

5. The wearable shoe shaper of claim 4, wherein the inner relief is further defined as having an inner side maximum height that is at least 0.5 inch greater than an outer side maximum height.

6. The wearable shoe shaper of claim 1, wherein the fifth toe vacancy is defined by a curved discontinuity between the toe box and the outer wing having a maximum bottom-to-top height between 0.5 inch and 1.5 inches, and a maximum front-to-back length of 1.0 inch and 4.5 inches.

7. The wearable shoe shaper of claim 6, wherein the fifth toe vacancy is further defined by a reinforced portion of the outer wing extending backward from the toe box about the curved discontinuity, the reinforced portion of the outer wing having a reinforced sheet thickness at least 10% greater than a sheet thickness of a non-reinforced portion of the contoured sheet.

8. The wearable shoe shaper of claim 1, wherein the toe box, the inner wing, and the outer wing are formed from a single contoured sheet.

9. The wearable shoe shaper of claim 8, wherein the sheet thickness of the single contoured sheet is between 0.47 inch and 0.094 inch.

10. The wearable shoe shaper of claim 1, wherein the toe box includes a plurality of ventilation holes passing through the contoured sheet, the plurality of ventilation holes each having a diameter of between 0.03 inch and 0.125 inch.

11. The wearable shoe shaper of claim 1, wherein the toe box, the inner wing, and the outer wing are together sized and dimensioned to fit within a rectangular volumetric envelope having a base of 6 inches long by 5 inches wide, and a height of 2 inches tall.

12. The wearable shoe shaper of claim 1, wherein the top, the front, the inner side, and the outer side of the toe box are orthogonal to each other and the lower of the shoe, within a tolerance of 10 degrees.

13. The wearable shoe shaper of claim 1, wherein the contoured sheet is made of plastic.

14. The wearable shoe shaper of claim 13, wherein the contoured sheet is configured to be cutable by a pair of household scissors.

15. A wearable shoe shaper for a shoe, the shoe having an upper and a lower, said shoe defining a front direction, a back direction, an inner direction, an outer direction, a top direction, a bottom direction, an inside direction and an outside direction, the wearable shoe shaper comprising:

a toe box formed from a contoured sheet configured to fit inside the shoe between a foot of a user and the shoe upper when worn, the toe box having a top side, a front, an inner side, and an outer side, relative to the shoe, the toe box configured to cover at least four toes of a human foot, the toe box further configured to conform to asymmetrical shapes and dimensions of one of a left human foot or a right human foot;

an inner wing formed from the contoured sheet, extending backward from the top side and the inner side of the toe box, the inner wing including an inner foot interface configured to rest alongside an inner side of the human foot, proximate a first metatarsal bone of said human foot; and an outer wing formed from the contoured sheet, extending backward from the top and the outer side of the toe box, the outer wing including an outer foot interface configured to rest alongside an outer side of the human foot, proximate a fifth metatarsal bone of said human foot; and wherein the toe box, the inner wing, and the outer wing are formed from a single contoured sheet;

wherein the toe box includes a plurality of ventilation holes passing through the contoured sheet;

wherein the toe box includes a mid-foot vacancy, said mid-foot vacancy defined as a recess or discontinuity in the contoured sheet at an upper back edge of the toe box, and arranged to avoid contact with the foot proximate an intermediate cuneiform bone during walking;

wherein the inner wing includes an inner relief, said inner relief defined as an elevated portion of the contoured sheet positioned above a navicular bone of the human foot, and arranged to conform to an elevated height of the navicular bone of the human foot; and wherein the outer wing further includes a fifth toe vacancy configured to expose a fifth toe of the human foot, as viewed from the outer side, the fifth toe vacancy is defined by a curved discontinuity between the toe box and the outer wing, and further defined by a reinforced portion of the outer wing extending backward from the toe box about the curved discontinuity.

16. The wearable shoe shaper of claim 15, wherein the sheet thickness of the single contoured sheet is between 0.47 inch and 0.094 inch;

wherein the plurality of ventilation holes of the toe box each have a diameter of between 0.03 inch and 0.125 inch;

wherein the mid-foot vacancy has a side-to-side width between 0.5 inch and 1.0 inch and a front-to-back length of 0.25 inch and 1.0 inch;

wherein the inner relief is further defined as having an inner side maximum height that is at least 0.5 inch greater than an outer side maximum height;

wherein the fifth toe vacancy is further defined by the curved discontinuity having a maximum bottom-to-top height between 0.5 inch and 1.5 inches, and a maximum front-to-back length of 1.0 inch and 4.5 inches;

wherein the reinforced portion of the outer wing has a reinforced sheet thickness at least 10% greater than a sheet thickness of a non-reinforced portion of the contoured sheet;

wherein the toe box, the inner wing, and the outer wing are together sized and dimensioned to fit within a rectangular volumetric envelope having a base of 6 inches long by 5 inches wide, and a height of 2 inches tall;

wherein the top, the front, the inner side, and the outer side of the toe box are orthogonal to each other and the lower of the shoe, within a tolerance of 10 degrees;

wherein the contoured sheet is made of plastic; and wherein the contoured sheet is configured to be cutable by a pair of household scissors.

17. A pair of wearable shoe shaper for a pair of shoes worn by a user, each shoe having an upper and a lower, and defining a front, a back, an inner side, an outer side, a top, a bottom, an inside and an outside, the pair of wearable shoe shaper comprising:

a left wearable shoe shaper including a left toe box formed from a left contoured sheet configured to fit inside a left shoe between a left foot of the user and the left shoe upper when worn, the left toe box having a top side, an inner side, and an outer side, relative to the left shoe, the left toe box configured to cover at least four toes of a human left foot, the left toe box further configured to conform to asymmetrical shapes and dimensions of the left human foot, a left inner wing formed from the left contoured sheet, extending backward from the top and the inner side of the left toe box, the left inner wing including an inner foot interface configured to rest against an inner side of the left human foot proximate a first metatarsal bone of said left human foot, a left outer wing formed from the left contoured sheet, extending backward from the top and the outer side of the left toe box, the left outer wing including an outer foot interface configured to rest against an outer side of the left human foot proximate a fifth metatarsal bone of said left human foot; and a right wearable shoe shaper including a right toe box formed from a right contoured sheet configured to fit inside a right shoe between a right foot of the user and the right shoe upper when worn, the right toe box having a top side, an inner side, and an outer side, relative to the right shoe, the right toe box configured to cover at least four toes of a human right foot, the right toe box further configured to conform to asymmetrical shapes and dimensions of the right human foot, a right inner wing formed from the right contoured sheet, extending backward from the top and the inner side of the right toe box, the right inner wing including an inner foot interface configured to rest against an inner side of the right human foot proximate a first metatarsal bone of said right human foot, a right outer wing formed from the right contoured sheet, extending backward from the top and the outer side of the right toe box, the right outer wing including an outer foot interface configured to rest against an outer side of the right human foot proximate a fifth metatarsal bone of said right human foot; and wherein each of the left and right outer wing further includes a fifth toe vacancy configured to expose a fifth toe of the left or right human foot, respectively, as viewed from the outer side, the fifth toe vacancy is defined by a curved discontinuity between the left or right toe box and the left or right outer wing, respectively, and is further defined by a reinforced portion of the left or right outer wing extending backward from the left or right toe box about the curved discontinuity.

18. The pair of wearable shoe shapers of claim 17, wherein the left toe box, the left inner wing, and the left outer wing are formed from a first single contoured sheet;

wherein the right toe box, the right inner wing, and the right outer wing are formed from a second single contoured sheet;

wherein each of the left and right toe box includes a plurality of ventilation holes passing through the respective single contoured sheet;

wherein each of the left and right toe box includes a mid-foot vacancy, said mid-foot vacancy defined as a recess or discontinuity in the contoured sheet at an upper back edge of the toe box of the left or right human foot, respectively, and arranged to avoid contact with said foot proximate an intermediate cuneiform bone during walking;

wherein each of the left and right inner wing includes an inner relief, said inner relief defined as an elevated portion of the contoured sheet positioned above a navicular bone of the left or right human foot, respectively, and arranged to conform to an elevated height of the navicular bone of the left or right human foot, respectively;

wherein each of the first and second single contoured sheet is made of plastic;

wherein each of the first and second single contoured sheet is configured to be cutable by a pair of household scissors; and wherein the each of the left and right toe box, inner wing, and outer wing are together sized and dimensioned to fit within a rectangular volumetric envelope having a base of 6 inches long by 5 inches wide, and a height of 2 inches tall.

* * * * *